US007435129B2

(12) United States Patent
Su et al.

(10) Patent No.: US 7,435,129 B2
(45) Date of Patent: Oct. 14, 2008

(54) CABLE CONNECTOR ASSEMBLY AND METHOD FOR MAKING THE SAME

(75) Inventors: Xian-Bao Su, Kunshan (CN); Jun-Qing Guo, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/888,587

(22) Filed: Aug. 1, 2007

(65) Prior Publication Data

US 2008/0032558 A1 Feb. 7, 2008

(51) Int. Cl.
*H01R 13/62* (2006.01)

(52) U.S. Cl. ..... 439/483; 439/606; 439/484

(58) Field of Classification Search ..... 439/483, 439/484, 606, 923

See application file for complete search history.

(56) References Cited

U.S. PATENT DOCUMENTS 6,319,049 B1 11/2001 Lee
6,808,410 B1 * 10/2004 Lee ..... 439/484
6,916,197 B1 * 7/2005 Wu ..... 439/484
6,976,865 B2 12/2005 Wu
D525,206 S 7/2006 Cheng et al.
2005/0054236 A1 * 3/2005 Shi et al. ..... 439/483

* cited by examiner

*Primary Examiner*—Tho D Ta
(74) *Attorney, Agent, or Firm*—Wei Te Chung

(57) ABSTRACT

A cable connector assembly (100) includes an insulative housing (1), a plurality of contacts (2) received in the insulative housing, a cable (6) electrically connecting with the contacts, a retention member (4), a pull tape (7) and a cover (5). The contacts have rear portions and the cable consists of a number of wires (61, 62) electrically connecting with the rear portions of the contacts to form connection area. The retention member is molded over the connection area. The cover shrouds the rear portion of the insulative housing, the retention member and part of the cable adjacent to the retention member. The pull tape has a fixing part and a pull part connecting with the fixing part. The fixing pull part of the pull tape is embedded in the cover. The pull part of the pull tape is exposed out of the cover for being pull to separate the cable connector assembly from a complementary connector.

15 Claims, 6 Drawing Sheets

CABLE CONNECTOR ASSEMBLY AND METHOD FOR MAKING THE SAME

BACKGROUND OF THE INVENTION

1. Field of the Invention

The present invention generally relates to a cable connector assembly and a method for making the same, and more particularly to a cable connector assembly with a pull tape and a method for making such cable connector assembly.

2. Description of Related Art

As it is known to us, a computer (server) commonly has a Hard Disk device (HDD), a motherboard (MB), and a cable connector assembly used for interconnecting the HDD and the MB. In the past, a cable connector assembly according with the standard of Parallel Advanced Technology Attachment (parallel ATA) was widely used for such kind of interconnection. However, in recent years, Serial Advanced Technology Attachment (Serial ATA) has developed fast, as Serial ATA has a number of advantages, such as higher-speed, lower profile, fewer pin-counts, and so on, thus, a cable connector assembly adapted for Serial ATA is gradually accepted and used as a main Input/Output (I/O) port for the HDD of the computer (server).

As the connector of a Serial ATA cable connector assembly with a lower profile, when it mates with corresponding complementary connector, a mating portion of the connector is received in the complementary connector, and bit of rear body portion of the connector is exposed outside of the complementary connector adapted for users holding. Further, as many electrical elements or devices are arranged nearby the complementary connector and little space is left for accommodating a user's fingers, so it may be difficult for the user to pull the connector out from the complementary connector. Therefore, a pull tape may be used to help pulling the connector out from the complementary connector easily. U.S. Pat. No. D525,206S discloses an electrical connector including an insulative housing, a number of contacts received in the insulative housing and a substantially L-shape cover molded on the rear portion of the insulative housing. The cover has a protruding rear portion extending along the mating portion between the electrical connector and a mating connector. The rear portion of the cover defines a through slot therethrough along a vertical direction perpendicular to the mating direction adapted for tying a pull tape. However, as the rear portion of the cover is relative longer along the mating direction, the electrical connector may interfere with other electrical elements around when plugged into or pulled from the complementary connector.

Hence, an improved cable connector assembly is highly desired to overcome the disadvantages of the related art.

SUMMARY OF THE INVENTION

Accordingly, an object of the present invention is to provide a low-profile cable connector assembly with a pull tape for space spare and compact configuration.

Another object of the present invention is to provide a method for making the aforementioned cable connector assembly.

In order to achieve the object set forth, a cable connector assembly in accordance with the present invention comprises an insulative housing, a plurality of contacts received in the insulative housing, a cable electrically connecting with the contacts, a pull tape and a cover. The contacts have rear portions and the cable consists of a plurality of wires electrically connecting with the rear portions of the contacts to form a connection area. The cover shrouds the rear portion of the insulative housing and part of the cable adjacent to the connection area. The pull tape has a fixing part and a pull part connecting with the fixing part. The fixing pull part of the pull tape is embedded in the cover. The pull part of the pull tape is exposed out of the cover for being pull to separate the cable connector assembly from a complementary connector.

Other objects, advantages and novel features of the invention will become more apparent from the following detailed description when taken in conjunction with the accompanying drawings.

DETAILED DESCRIPTION OF THE INVENTION

Figure 1:
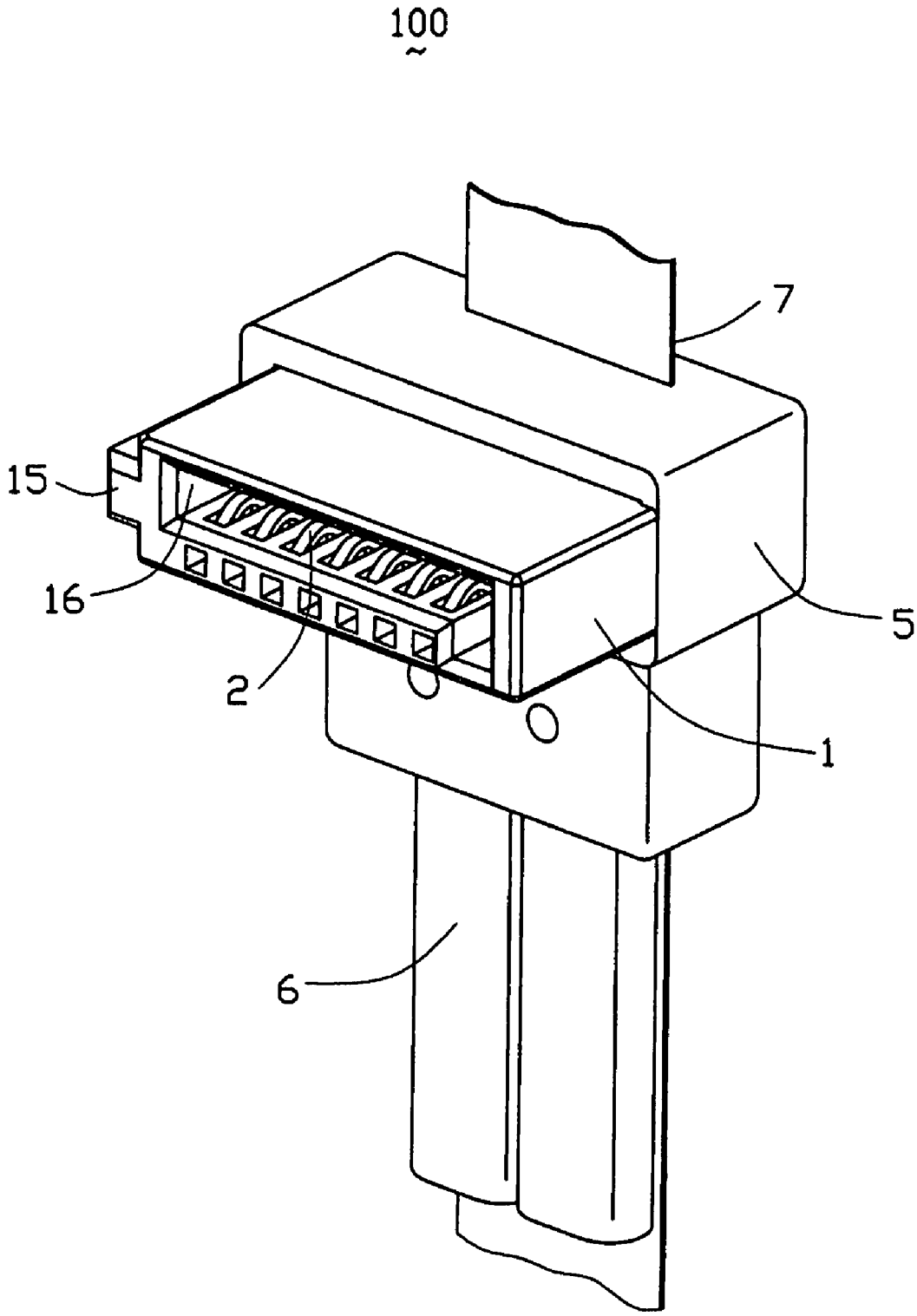
FIG. 1 is an assembled, perspective view of a cable connector assembly in accordance with the present invention.

Reference will now be made in detail to the preferred embodiment of the present invention.

Referring to FIGS. 1-5, a cable connector assembly 100 in accordance with the present invention comprises an insulative housing 1, a plurality of contacts 2 received in the insulative housing 1, a spacer 3 mounted to a rear portion of the insulative housing 1, a cable 6 electrically connecting with the contacts 2, a retention member 4 molded over a connection area between the contacts 2 and the cable 6, a cover 5 shrouding a rear portion of the insulative housing 2, the retention member 4 and a part of the cable 6 adjacent to the retention member 4, and a pull tape 7 sandwiched between the retention member 4 and the cover 5.

The insulative housing 1 defines a top wall 11, a bottom wall 12 opposite to the top wall 11, a pair of transversal walls 13, 14 joining to the top wall 11 and the bottom wall 12 to corporately form an L-shaped receiving space 16. The transversal wall 14 further forms a guiding post 15 along front-to-back direction for guiding the cable connector assembly 100 mating with a complementary connector (not shown) properly. The bottom wall 12 has a plurality of slots 17 for receiving the contacts 2. The rear edges of the top wall 11 and the bottom wall 12 respectively form a rib 19 extending along a transversal direction. The rear portion of the insulative housing 1 further defines a substantially rectangular depression 18 recessed forwardly therefrom and communicating with the slots 17.

The contacts 2 are aligned in a row along the transversal direction and received in corresponding slots 17 of the insulative housing 1. Each contact 2 comprises a curved contacting portion 21, a retention portion 23 with barbs 231 formed thereon and a rear portion 22 extending rearwardly then downwardly from the retention portion 23.

The spacer 3 is of rectangular-shape and has substantially the same dimension as that of the rectangular depression 18 of the insulative housing 1. The spacer 3 defines a number of holes 31 arranged in a row, and the rear portions 22 of the contacts 2 firstly pass through the holes 31 of the spacer 3 and then are bent downwardly angled 90 degrees. Further more, the top and the bottom edges of the spacer 3 form some protuberances 32 which interfere with the rectangular depression 18 for increasing the retaining force between the rectangular depression 18 and the spacer 3. The spacer 3 is used for preventing the molten plastic material from flowing into the slots 17 of the insulative housing 1 when forming the retention member 4.

The cable 6 is in accordance with Serial ATA standard and extends along a second direction perpendicular with a first direction along which the cable connector assembly 100 mates with the complementary connector (not shown). The cable 6 consists of two group of side-by-side sub-cables shrouded by an insulative jacket 63. Each sub-cable has a pair of adjacent signal wires 61 for transmitting differential signals and a pair of grounding wires 62 disposed outside of the signal wires 61.

The retention member 4 is an inverted-convexity member made of polyethylene (PE) material, with a broad upside portion and a narrow underside portion along the vertical direction. The retention member 4 is pre-molded over the connection area between the contacts 2 and the cable 6, with the narrow upside portion molded on the signal wires 61 and the grounding wires 62, while the broad underside portion molded on the rear portions 22 of the contacts 2, thus, the cable 6 and the contacts 2 may be combined much more reliably. The pull tape 7 is a strap-shape member with substantially equal width at each part of itself along the transversal direction and made of polyester (PET) material. Further, the pull tape 7 comprises a first pull part 71 extending upward beyond the top surface of the cover 5, a second pull part 72 extending downward beyond the bottom surface of the cover 5 and a fixing part 70 connecting with the first pull part 71 and the second pull part 72 and embedded within the cover 5. The retention member 4 further defines a rear surface having a rectangular concave 41 recessing inwardly therefrom for disposing the fixing part 70 of the pull tape 7 much more accurately and easily.

The cover 5 is a substantially L-shape member made of polyvinyl chloride (PVC) material, with a large-size upside part and a small-size underside part. The cover 5 further defines a hollow 51 in the large-size upside part for accommodating the rear portion of the insulative housing 1, the retention member 4 and the cable 6 nearby. The large-size upside part of the cover 5 is molded over the rear portion of the insulative housing 1 and the retention member 4, while the small-size underside part is molded over the cable 6 adjacent to the retention member 4. The fixing part 70 of the pull tape 7 is sandwiched between the retention member 4 and the cover 5.

When making the cable connector assembly 100 in accordance with the present invention, the insulative housing 1, the contacts 2 and the spacer 3 are firstly provided. Secondly, the contacts 2 are inserted into the slots 17 of the insulative housing 1 along the first direction, with the contacting portions 21 of the contacts 2 partially exposed in the receiving space 16 of the insulative housing 1, the retention portions 23 retained in the slots 17 with barbs 231 piercing into corresponding side walls of the slots 17, and the rear portions 22 of the contacts 2 extending beyond the rear edge of the insulative housing 1. Thirdly, the spacer 3 is assembled to be received in the rectangular depression 18 of the insulative housing 1, with the rear portions 22 of the contacts 2 passing through the holes 31 of the spacer 3 and then bent downwardly. Fourthly, the signal wires 61 and the grounding wires 62 of the cable 6 are soldered to the rear portions 22 of the contacts 2, with two adjacent grounding wires 62 of the pair of the sub-cables together connecting to the same middle contact 2 and other grounding wires 62 and signal wires 61 connecting to other contacts 2. Fifth, putting the insulative housing 1 and the cable 6 adjacent to the insulative housing 1 into a mold case (not shown), then the molten polyethylene (PE) material is ejected into the mold case and the connection area of the cable 6 and the contacts 2 are immerged in the molten polyethylene, thus, the rear portions 22 of the contacts 2, the signal wires 61, the grounding wires 62 and part of insulative jacket 63 adjacent to the rear portions 22 of the contacts 2 are over-molded by the retention member 4. Sixth, the pull tape 7 is assembled to the retention member 4, with the fixing part 70 of the pull tape 7 positioned in the concave 41 of the retention member 4 via retaining means, and the retaining means may be some needles pressing onto the fixing part 70 or glue applied to the fixing part 70 that makes the pull tape 7 attach to the retention member 4. Seventh, the molten polyvinyl chloride (PVC) is molded over the rear portion of the insulative housing 1, the retention member 4, the fixing part 70 of the pull tape 7 and the insulative jacket 61 of the cable 6 adjacent to the retention member 4 to form the cover 5, with both the first pull part 71 and the second pull part 72 exposed out of the cover 5. The ribs 19 of the insulative housing 1 interfere with the cover 5, thus, the cover 5 combines with the insulative housing 1 much more reliably.

Figure 2:
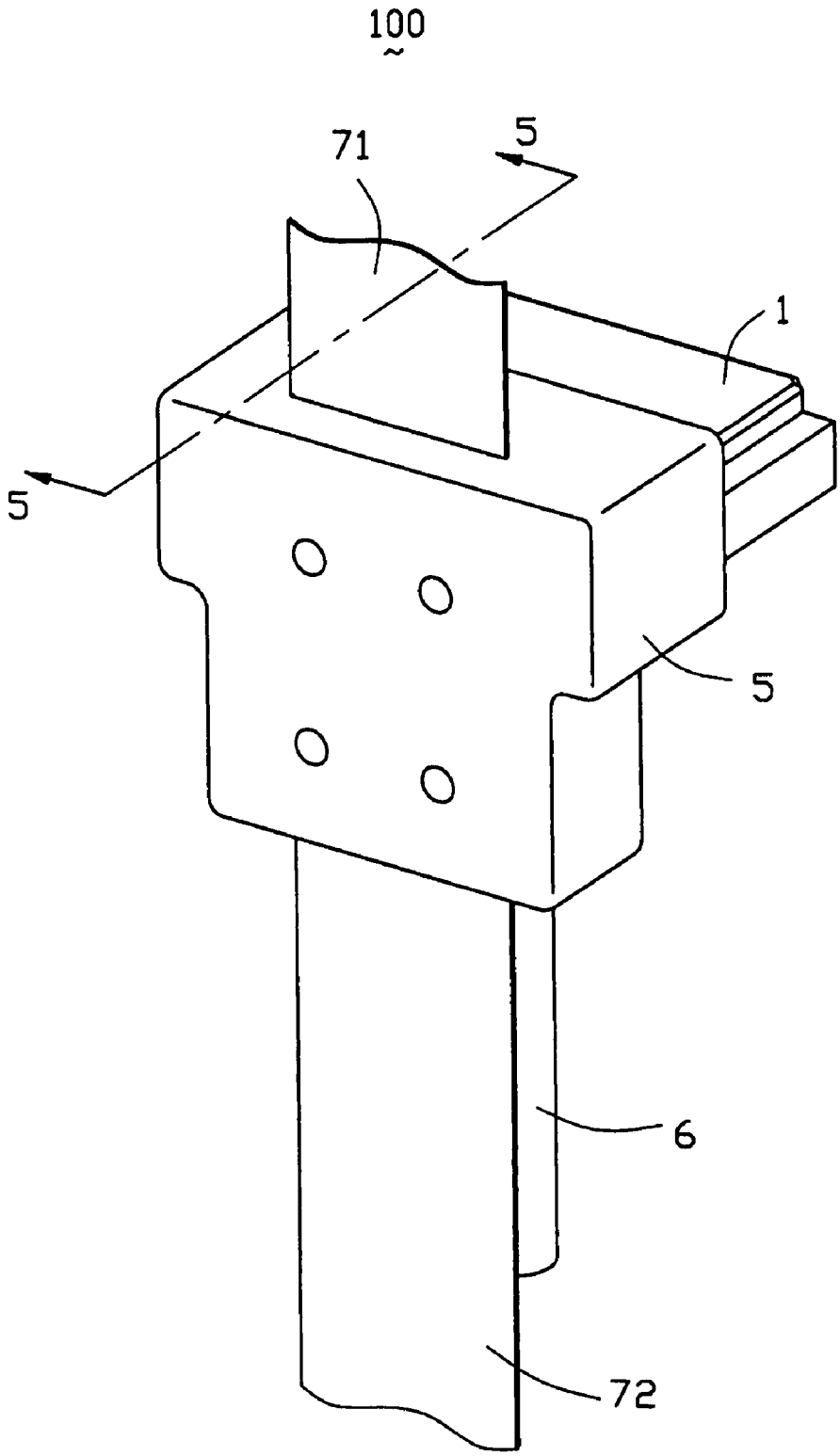
FIG. 2 is a view similar to FIG. 1, but viewed from another aspect.
Figure 3:
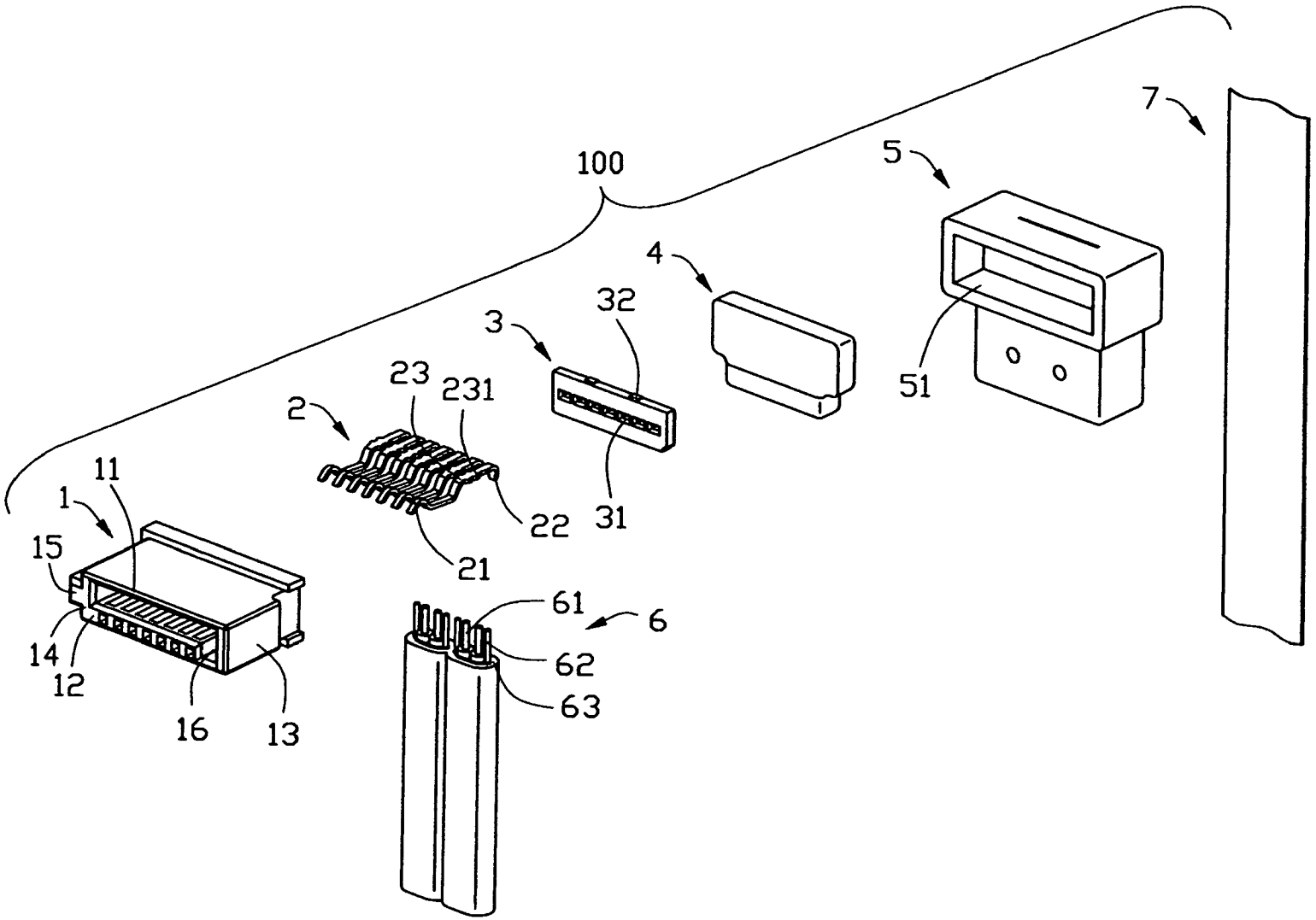
FIG. 3 is an explored, perspective view of FIG. 1.
Figure 4:
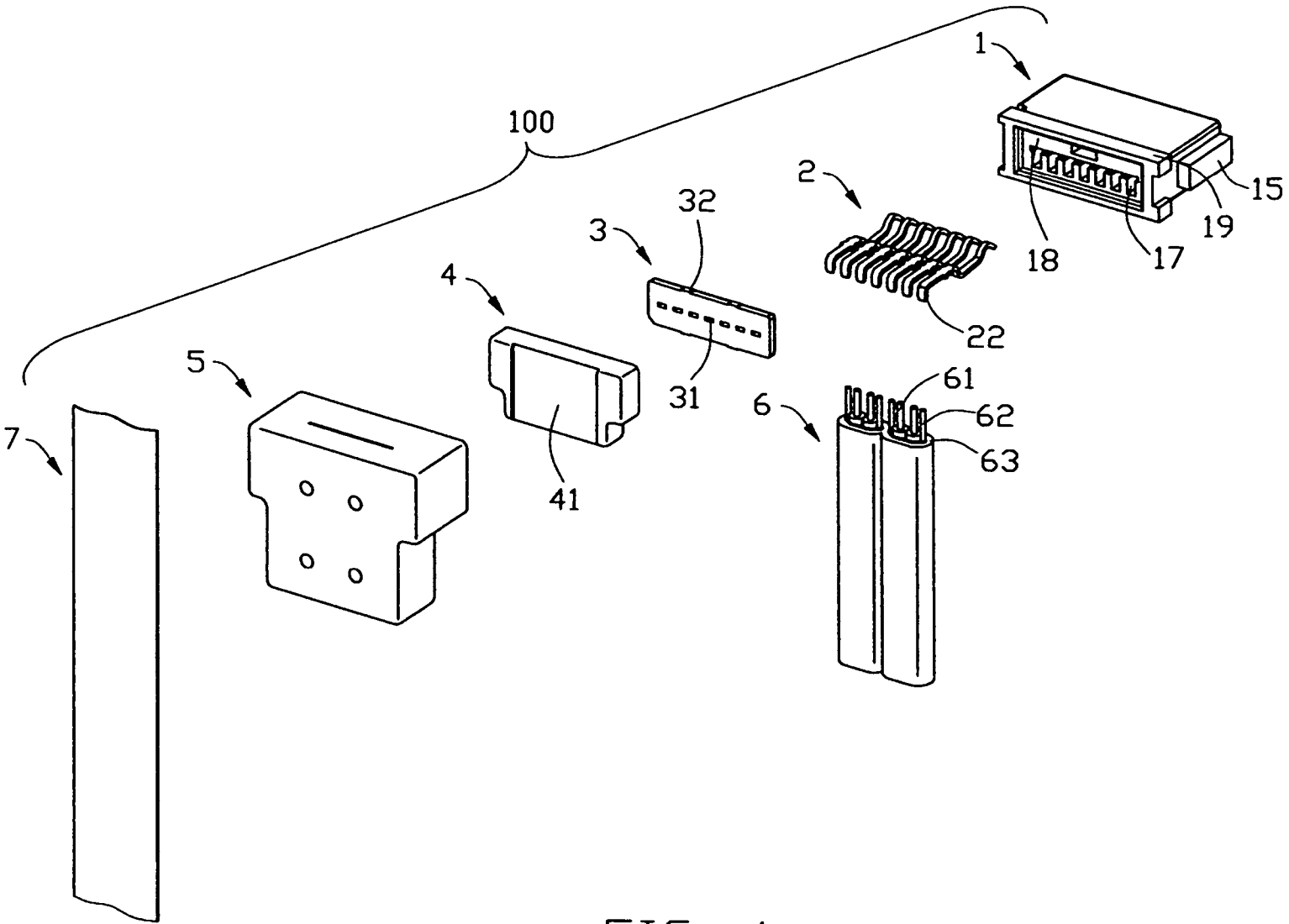
FIG. 4 is a view similar to FIG. 3, but viewed from another aspect.
Figure 5:
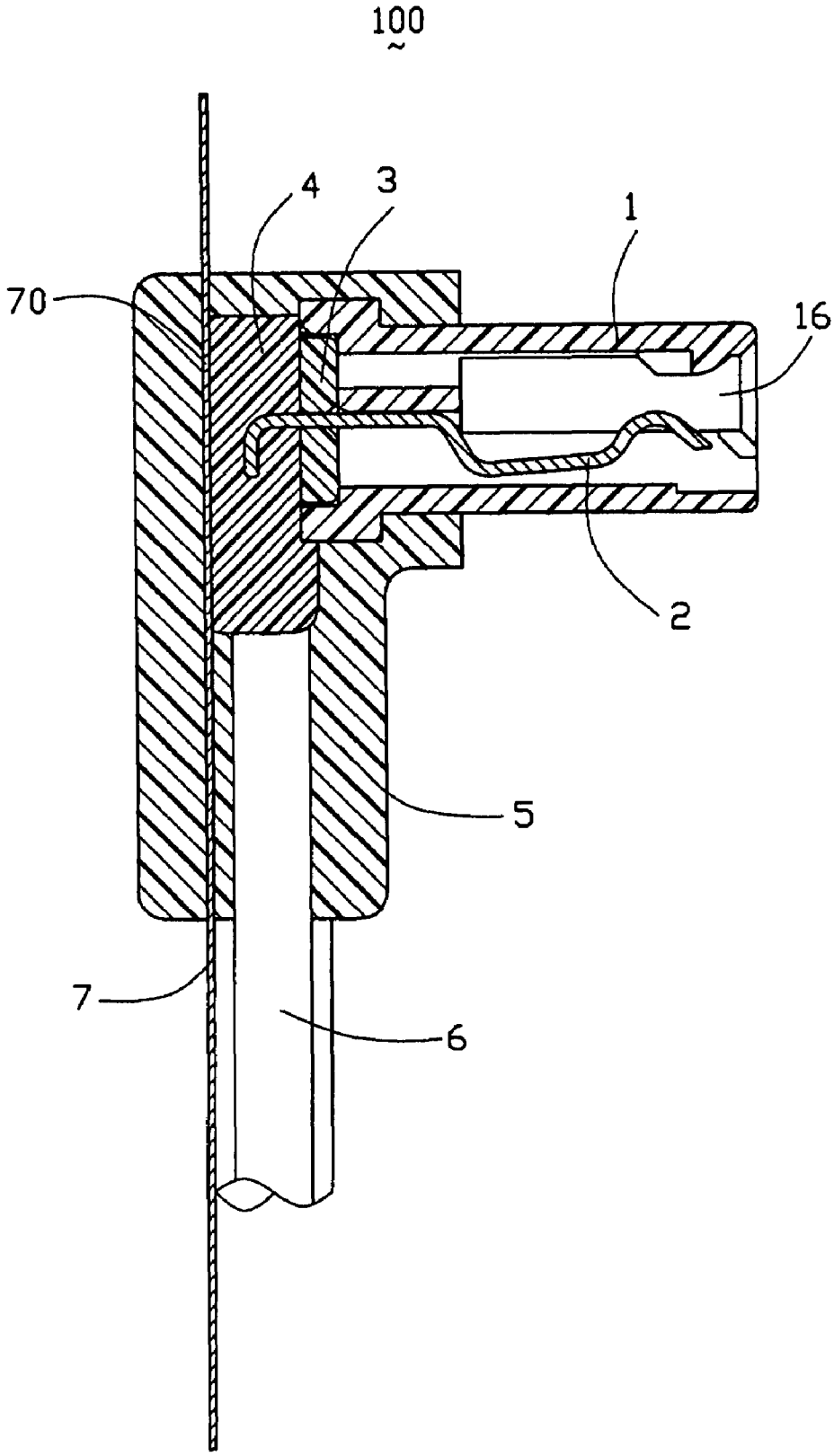
FIG. 5 is cross-section view of FIG. 2 taken along line 5-5.
Figure 6:
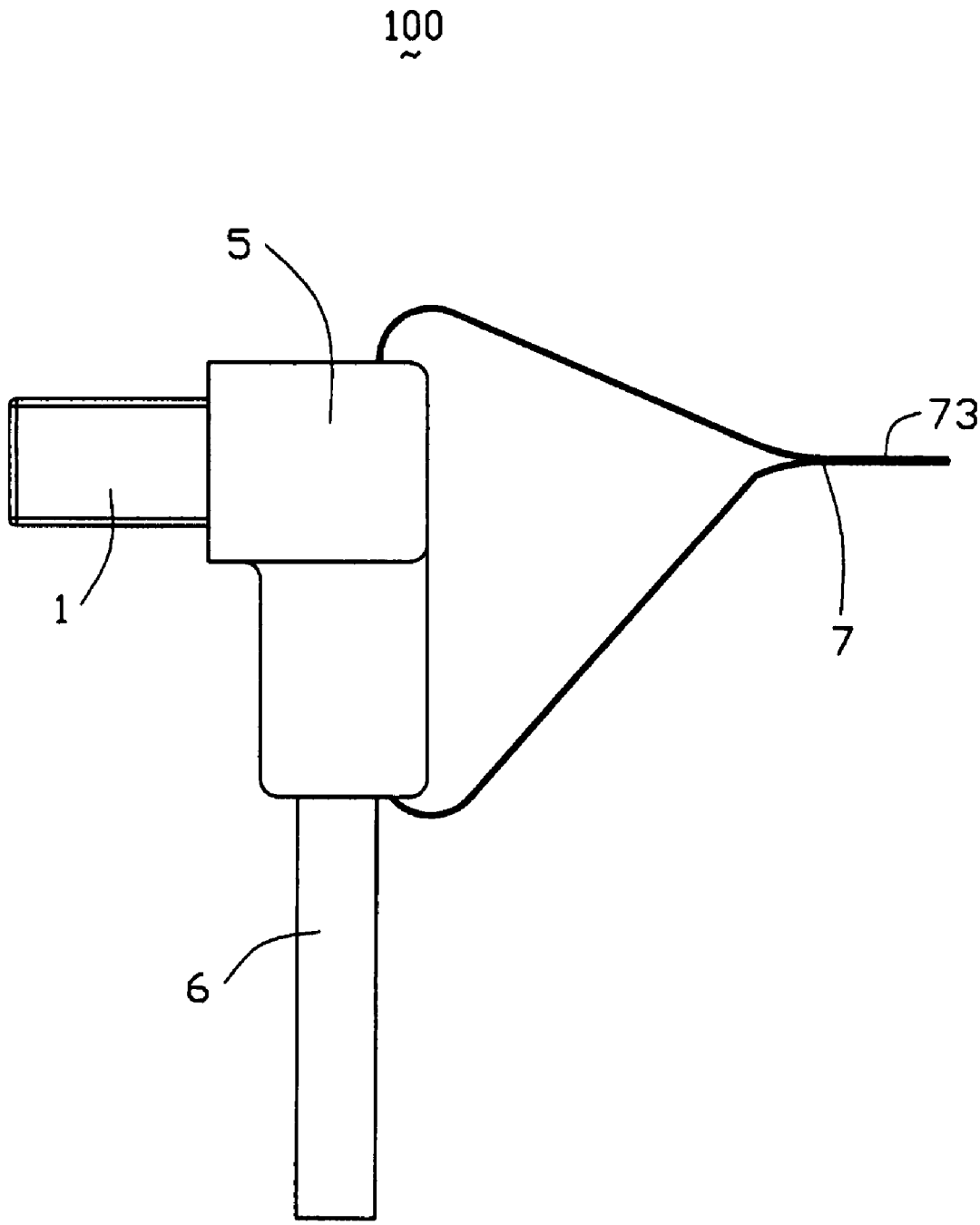
FIG. 6 is a right side elevational view of the cable connector assembly with a pull tape in ready-use state.

Referring to FIGS. 2 and 6, when using the cable connector assembly 100, the first pull part 71 and the second pull part 72 of the pull tape 7 are aligned with each other and integrated together by glue to form a holding portion 73. The holding portion 73 extends rearward along the first direction. When the cable connector assembly 100 is drew out from the complementary connector, there is no addition torque between the cable connector assembly 100 and the complementary connector, for there is no bias between the holding portion 73 and the first mating direction. Thus, the cable connector assembly 100 can be pulled out from the complementary connector easily. As the pull tape 7 is embedded in the cover 5 directly, so it is unnecessary to define a protrusion with a slot thereon for tying a pull tape, and the length of the cable connector assembly 100 along the first direction is greatly reduced, thus, the cable connector assembly 100 may not interfere with the electrical components nearby.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly adapted for mating with a complementary connector, comprising:

an insulative housing;

a plurality of contacts received in the insulative housing and each contact having a mating portion and a rear portion;

a cable having a plurality of wires electrically connecting with the rear portions of the contacts to form connection area between the rear portion of the contacts and the wires adjacent to the contacts;

a retention member molded over the connection area;

a cover shrouding the rear portion of the insulative housing and part of the cable adjacent to the connection area; and a pull tape having a fixing part and a pull part connecting with the fixing part;

and wherein the fixing part is embedded in the cover and sandwiched between the retention member and the cover; and the pull part is exposed out of the cover for being pulled to separate the cable connector assembly from the complementary connector.

2. The cable connector assembly as claimed in claim 1, wherein the fixing pan of the pull tape is molded together with the cover.

3. The cable connector assembly as claimed in claim 1, wherein the retention member defines a rear surface with a concave recessing inwardly therefrom, wherein the a fixing part of the pull tape laid in the concave.

4. The cable connector assembly as claimed in claim 1, wherein the pull part of the pull tape comprises a first pull part and a second pull part of the pull tape to together form a pull portion extending rearward along a first direction which the cable connector assembly mates the complementary connector.

5. The cable connector assembly as claimed in claim 1, wherein the pull tape is made of polyester (PET) material.

6. The cable connector assembly as claimed in claim 1, wherein the insulative housing defines an L-shaped receiving space adapted for receiving a mating portion of the complementary connector.

7. The cable connector assembly as claimed in claim 1, wherein the cable comprising a pair of group sub-cables, and wherein each sub-cable comprises a pair of adjacent signal wires and other pair of grounding wires disposed outside of the signal wires.

8. The cable connector assembly as claimed in claim 1, further comprising a spacer.

9. The cable connector assembly as claimed in claim 8, wherein the spacer defines a plurality of holes through which the rear portions of contacts pass.

10. The cable connector assembly as claimed in claim 8, wherein the insulative housing defines a rear portion with a depression, and wherein the spacer is interferentially received in the depression.

11. A method of making a cable connector assembly, the method comprising steps of:

providing an insulative housing;

providing a plurality of contacts, each contact having a mating portion and a rear portion;

providing a cable, the cable comprising a number of wires and an insulative jacket shrouding the wires;

providing a pull tape, the pull tape comprising a fixing part and a pull part connecting with the fixing part;

inserting the contacts into the insulative housing;

soldering the wires to the rear portions of the contacts to form connection area;

over-molding on the rear portion of the insulative housing, the connection area, the pull tape and the cable adjacent to the connection area to form a cover, with the fixing part of the pull tape together molded within the cover and the pull part exposed out of the cover.

12. The method of making a cable connector assembly as claimed in claim 11, wherein the pull part of the pull tape comprises a first pull part and a second pull pan of the pull tape combined together to form a pull portion extending rearward along first direction which the cable connector assembly mates with a complementary connector.

13. The method of making a cable connector assembly as claimed in claim 11, further comprising a step of pre-molding the pre-molding over the connection area to form an retention member.

14. A cable connector assembly comprising:

insulated housing defining a plurality of passageways;

a plurality of contacts disposed in the corresponding passageways, respectively;

a first insulative member attached to the housing and holding contact tails of the contacts;

a second insulative member molded over the housing and the first insulative member, and a flexible pull tape with two opposite ends of the pull tape extend out of the first and second insulative members to an exterior and jointed together for grasping, wherein said flexible pull tape is fastened to the second insulative member without relative movement therebetween.

15. The cable connector assembly as claimed in claim 14, wherein said flexible pull tape sandwiched between the first insulative member and the second insulative member.

* * * * *